US007909215B2

(12) United States Patent
McGuire et al.

(10) Patent No.: US 7,909,215 B2
(45) Date of Patent: Mar. 22, 2011

(54) GOLF BAG WITH STRAP GUIDE ASSEMBLY

(75) Inventors: Brian J. McGuire, Tempe, AZ (US); Frank A. Quartarone, III, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 810 days.

(21) Appl. No.: 11/848,914

(22) Filed: Aug. 31, 2007

(65) Prior Publication Data

US 2008/0164165 A1 Jul. 10, 2008

Related U.S. Application Data

(60) Provisional application No. 60/884,259, filed on Jan. 10, 2007.

(51) Int. Cl.
*A45F 3/04* (2006.01)
*A45F 3/02* (2006.01)

(52) U.S. Cl. ..... 224/627; 224/631; 224/254; 224/578; 224/645; 206/315.3

(58) Field of Classification Search ..... 224/627, 224/631, 645, 254, 578; 206/315.3
See application file for complete search history.

(56) References Cited

U.S. PATENT DOCUMENTS

| | | | | |
|---|---|---|---|---|
| 5,411,194 | A * | 5/1995 | Nagasawa et al. | 224/254 |
| 5,636,778 | A | 6/1997 | Jones et al. | |
| D412,396 | S * | 8/1999 | Reimers et al. | D3/255 |
| 5,954,255 | A | 9/1999 | Beebe et al. | |
| 6,460,747 | B1 | 10/2002 | Tuerschmann et al. | |
| 6,669,069 | B2 | 12/2003 | Suggs | |
| 7,059,504 | B2 | 6/2006 | Suggs | |

FOREIGN PATENT DOCUMENTS

WO 2005/030001 A1 4/2005

* cited by examiner

*Primary Examiner* — Tri M Mai

(57) ABSTRACT

A golf bag includes a first shoulder strap attached to the body of the golf bag at its upper end on a first side of the spinal axis of the body and at its lower end on the opposite second side of the spinal axis of the body. A second shoulder strap is attached to the body at its upper and lower ends on the sides opposite the first shoulder strap, so that the two shoulder straps cross each other over the spinal axis of the body. A strap guide assembly comprising an elastic cord is connected to an intermediate portion of the second shoulder strap to urge it toward the first side of the golf bag to prevent the second shoulder strap from falling away from the golfer as the golf bag is hoisted onto the golfer's shoulders.

20 Claims, 2 Drawing Sheets

GOLF BAG WITH STRAP GUIDE ASSEMBLY

This is a nonprovisional application claiming the benefit of provisional application No. 60/884,259 filed Jan. 10, 2007.

BACKGROUND OF THE INVENTION

This invention relates generally to golf equipment and, in particular, to shoulder strap assemblies for golf bags.

Golf bags used for carrying golf clubs on a golf course usually have either a single shoulder strap for supporting the golf bag on one shoulder or a dual shoulder strap arrangement for supporting the golf bag on both shoulders. Dual shoulder strap arrangements have an advantage in that the weight of the golf bag may be supported on both shoulders for carrying the golf bag relatively long distances yet may be carried on one shoulder for short distances such as across a putting green. When a golfer lifts a golf bag with a dual shoulder strap arrangement into position for carrying, the golfer first lifts the primary shoulder strap onto his or her strong shoulder (typically the right shoulder for a right-handed golfer) then reaches around to grasp the secondary strap to loop over his or her other shoulder. Occasionally, if the golf bag is hoisted the wrong way, the secondary strap will fall on the side of the golf bag that is furthest away from the golfer's body, making it somewhat inconvenient to reach around to grasp the secondary shoulder strap.

SUMMARY OF THE INVENTION

The present invention comprises a golf bag, including a body and a shoulder strap assembly. According to an illustrative embodiment of the invention, the shoulder strap assembly comprises a first shoulder strap attached to the body at its upper end on a first side of the spinal axis of the body and at its lower end on an opposite second side of the spinal axis of the body. The golf bag also includes a second shoulder strap attached at its upper and lower ends on the sides opposite the first shoulder strap so that the two shoulder straps cross each other over the spinal axis of the body. A strap guide assembly comprising an elastic cord is connected to an intermediate portion of the second shoulder strap to urge it toward the first side of the golf bag. Since the first side of the golf bag will be closer to the golfer as the golf bag is lifted into position, urging the second shoulder strap toward the first side of the golf bag enables the golfer to quickly grab the second shoulder strap without the necessity of reaching over the second side of the golf bag.

DESCRIPTION

Figure 1:
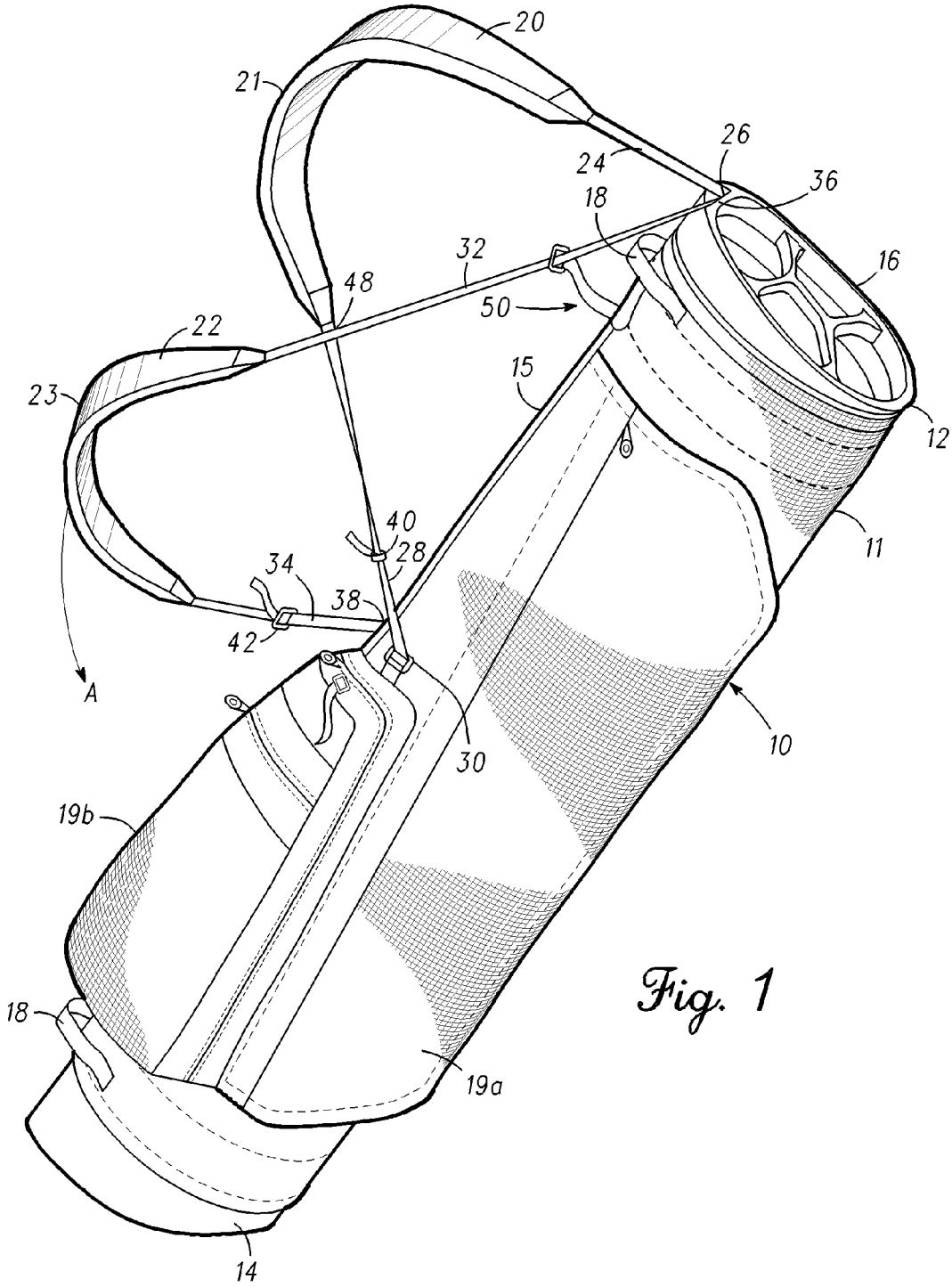
FIG. 1 is a perspective view of a golf bag incorporating features of the present invention.
Figure 2:
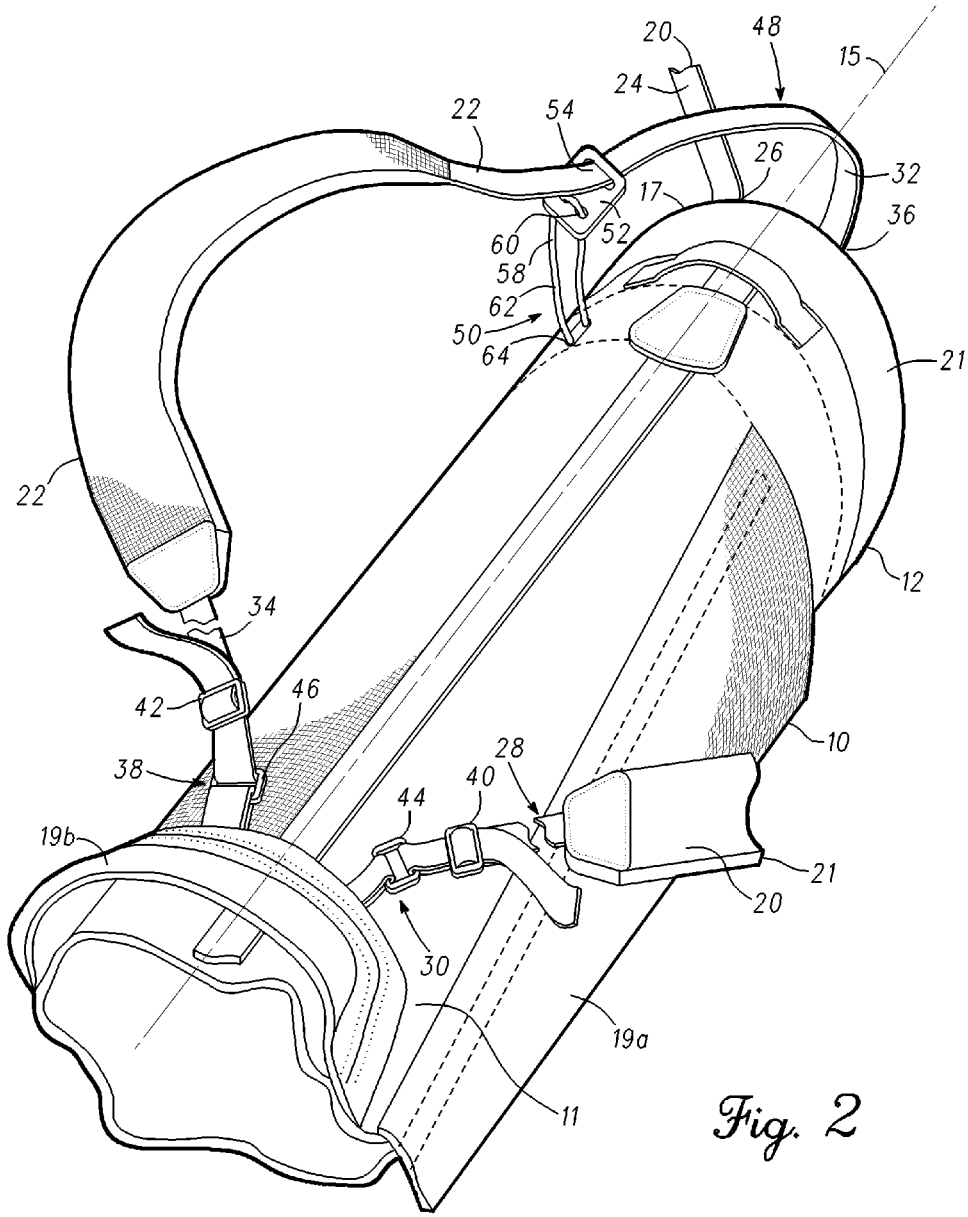
FIG. 2 is an enlarged perspective view of the golf bag shown in FIG. 1.

With reference to FIGS. 1 and 2, a golf bag 10 has a generally tubular body 11 with a top end 12, a bottom end 14, and a spinal axis 15 extending longitudinally between the top and bottom ends 12 and 14. The top end 12 of the body 11 includes a throat structure 16 similar to that disclosed in U.S. Pat. No. 4,596,328 to Solheim incorporated herein by reference. Handles 18 may be provided on the body 11 near its top end 12 and bottom end 14. Golf bag 10 may also be equipped with accessory pockets 19*a* and 19*b* mounted on body 11.

Golf bag 10 includes a shoulder strap assembly that includes a first shoulder strap 20 and a second shoulder strap 22. First shoulder strap 20 has an upper end 24 attached to the body 11 at a first location 26 proximal top end 12 of body 11. First shoulder strap 20 also has a lower end 28 attached to body 11 at a second location 30, which is spaced apart from top end 12 and is intermediate the top and bottom ends 12 and 14 of body 11. First shoulder strap 20 includes an elongated pad 21 between its upper and lower ends 24 and 28. With particular reference to FIG. 2, first location 26 is on a first side 17 of spinal axis 15 while second location 30 is located on the opposite second side 21 of spinal axis 15. This orientation of first and second locations 26 and 30 causes first shoulder strap 20 to cross over spinal axis 15 between upper end 24 and lower end 28 of first shoulder strap 20.

Second shoulder strap 22 has upper end 32 and lower end 34 attached to body 11 at third and fourth locations 36 and 38 respectively. Second shoulder strap 22 includes an elongated pad 23 between its upper and lower ends 32 and 34. Third location 36 is on second side 21 of spinal axis 15 while fourth location is on first side 17 of spinal axis 15. The orientation of the third and fourth locations 36 and 38 causes second shoulder strap 22 to cross over spinal axis 15 between its upper and lower end 32 and 34 and also to cross over first shoulder strap 20.

First shoulder strap 20 has an adjustment device 40 disposed at its lower end 28 for adjusting the overall length of strap 20 as measured between first location 26 and second location 30. Similarly, second shoulder strap 22 has an adjustment device 42 disposed on its lower end 34 for adjusting the overall length of strap 22 as measured between third location 36 and fourth location 38. By utilizing the adjustment devices 40 and 42, shoulder straps 20 and 22 may have their overall lengths adjusted independently as desired. Further adjustment devices (not shown) may be provided on the upper ends 24 and 32 of straps 20 and 22 in addition to or in lieu of adjustment devices 40 and 42. Upper ends 24 and 32 of straps 20 and 22, respectively, are secured in slots (not shown) formed in throat 16 at first location 26 and third location 36. A retractor (not shown) may be incorporated into throat structure 16 to take up slack in first and second shoulder straps 20 and 22 when not in use. Lower ends 28 and 34 of straps 20 and 22 extend through rings 44 and 46 mounted on body 11 at second and fourth locations 30 and 38. Alternatively, strap lower ends 28 and 34 may be sewn directly to the body 11 at locations 30 and 38 thereby eliminating rings 44 and 46.

When golf bag 10 is carried by a golfer with first shoulder strap 20 looped over one shoulder and the second shoulder strap 22 looped over the other shoulder, first and second shoulder straps 20 and 22 are arranged to cross each other at an intersection point 48 that is substantially midway between the golfer's shoulders. This causes golf bag 10 to be supported evenly by the first and second shoulder straps 20 and 22 which is a great advantage over a single strap arrangement. During the process of hoisting the golf bag 10 onto the golfer's shoulder, however, as the golf bag 10 is lifted by first shoulder strap 20, second shoulder strap 22 can fall away from the user toward second side 21 of spinal axis 15 as shown by arrow "A" in FIG. 1. When the second shoulder strap 22 falls away in such a manner, it can be inconvenient for the golfer to reach around the body 11 to grasp the second shoulder strap 22.

Accordingly, golf bag 10 includes a strap guide assembly 50 that prevents second shoulder strap 22 from falling onto second side 21 of golf bag 10. Strap guide assembly 50 comprises a shackle 52 made of a lightweight material such as ABS or similar thermoplastic. Shackle 52 has a first eye 54 through which an intermediate portion 48 of second shoulder strap 22 is passed. A resilient member 56 is attached at one end 58 to a second eye 60 formed in shackle 52 and at a second end 62 to a fifth location 64 that is spaced apart from top end 12 toward bottom end 14 of body 11 on first side 17 of spinal axis 15. Resilient member 56 may be any conventional resilient means such as a spring, spring retractor or other similar device but in the illustrative embodiment comprises an elastic cord having sufficient resiliency to urge second shoulder strap 22 toward first side 17 when second shoulder strap 22 is unloaded yet has sufficient elongation to permit second shoulder strap 22 to extend substantially straight from third location 36 to the user's shoulder when second shoulder strap 22 is loaded. The resilient member 56 applies tensile force between the intermediate portion 48 of the second shoulder strap 22 and the fifth location 64.

Although certain illustrative embodiments and methods have been disclosed herein, it will be apparent from the foregoing disclosure to those skilled in the art that variations and modifications of such embodiments and methods may be made without departing from the spirit and scope of the invention. For example, in lieu of an external strap guide, second strap may be urged toward the first side by an internal stiffener. Accordingly, it is intended that the invention should be limited only to extent required by the appended claims and the rules and principals of applicable law.

What is claimed is:

1. A golf bag comprising:

a body having a generally hollow tubular shape with an inside, an outside, a top end and a bottom end, said body further comprising a spinal axis extending in a longitudinal direction along said body;

a shoulder strap assembly comprising a first shoulder strap and a second shoulder strap, said first shoulder strap having an upper end attached to said body at a first location proximal the top end of said body and a lower end attached to said body at a second location intermediate the top and the bottom ends of said body, said second shoulder strap having an upper end attached to said body at a third location proximal the top end of said body and a lower end attached to said body at a fourth location intermediate the top and bottom ends of said body; and a strap guide assembly including a resilient member operatively attached between said second shoulder strap and said body, said resilient member applying tensile force between an intermediate portion of said second shoulder strap and a fifth location on said body intermediate the top end and the bottom end thereof, wherein the intermediate portion of said second shoulder strap is outside the body.

2. The golf bag of claim 1, wherein said resilient member is slidably attached to said second shoulder strap intermediate the upper and lower ends of said second shoulder strap.

3. The golf bag of claim 2, wherein said resilient member is attached to a shackle having an eye and wherein said second shoulder strap passes through the eye in said shackle.

4. The golf bag of claim 1, wherein said resilient member is an elastic cord.

5. The golf bag of claim 1, wherein:

said first location is laterally offset toward a first side of the spinal axis, and said second location is laterally offset toward a second side of the spinal axis opposite the first side, whereby said first shoulder strap extends diagonally across the spinal axis; and said third location is laterally offset toward the second side of the spinal axis and said fourth location is laterally offset toward the first side of the spinal axis, whereby said second shoulder strap extends diagonally across the spinal axis and crosses said first shoulder strap.

6. The golf bag of claim 5, wherein said resilient member urges said second shoulder strap toward the first side of the spinal axis.

7. The golf bag of claim 6, wherein said resilient member is of sufficient strength to displace the second shoulder strap toward the first side of the spinal axis when the second shoulder strap is unloaded, but is sufficiently compliant to allow the intermediate portion of said second shoulder strap to extend substantially straight when under load.

8. A golf bag comprising:

a body having a generally tubular shape with an inside, an outside, a top end and a bottom end, said body further comprising a spinal axis extending in a longitudinal direction along said body, said spinal axis dividing the outside of said body into a first side and a second side;

a shoulder strap assembly comprising a first shoulder strap and a second shoulder strap, said first shoulder strap having an upper end attached to said body proximal the top end of said body offset toward said first lateral side, said second shoulder strap having an upper end attached to said body proximal the top end of said body offset toward said second lateral side; and means disposed on the outside of said body for urging an intermediate portion of said second shoulder strap toward said first side.

9. The golf bag of claim 8, wherein said means for urging comprises a strap guide assembly slidably attached to said second shoulder strap intermediate the upper and lower ends of said second shoulder strap.

10. The golf bag of claim 8, wherein said first shoulder strap further comprises a lower end attached to said body offset toward said second side and wherein said second shoulder strap further comprises a lower end attached to said body intermediate the top and bottom ends of said body offset toward said first side.

11. The golf bag of claim 9, wherein said strap guide assembly comprises a resilient member operatively attached between said body and said second shoulder strap.

12. The golf bag of claim 11, wherein said strap guide assembly further comprises a shackle disposed between said resilient member and said second shoulder strap.

13. The golf bag of claim 12, wherein said resilient member is an elastic cord.

14. The golf bag of claim 13, wherein said shackle includes an eye through which said second shoulder strap passes.

15. A golf bag comprising:

a body having a generally tubular shape with an inside, an outside, a top end and a bottom end, said body further comprising a spinal axis extending in a longitudinal direction along said body said spinal axis dividing the outside of said body into a first side and a second side opposite the first side;

a shoulder strap assembly comprising a first shoulder strap and a second shoulder strap, said first shoulder strap having an upper end attached to said body at a first location proximal the top end of said body, laterally offset toward the first side and a lower end attached to said body at a second intermediate the top and bottom ends of said body offset toward the second side, said second shoulder strap having an upper end attached to said body at a third location proximal the top end of said body offset toward the second side and a lower end attached to said body at a fourth location intermediate the top and bottom ends of said body offset toward the first side, whereby said first shoulder strap and said second shoulder strap each extends diagonally across the spinal axis; and means disposed on the outside of said body for urging an intermediate portion of said second shoulder strap toward said first side.

16. The golf bag of claim 15, wherein said means for urging comprises a strap guide assembly slidably attached to said second shoulder strap intermediate the upper and lower ends of said second shoulder strap.

17. The golf bag of claim 16, wherein said strap guide assembly comprises a resilient member attached to a shackle.

18. The golf bag of claim 17, wherein said shackle includes an eye through which said second shoulder strap passes.

19. The golf bag of claim 18, wherein said resilient member is an elastic cord.

20. The golf bag of claim 16, wherein said strap guide assembly is attached to said body at a location intermediate the top and bottom ends of said body.

* * * * *